US010125990B2

(12) United States Patent
Morales

(10) Patent No.: US 10,125,990 B2
(45) Date of Patent: Nov. 13, 2018

(54) FILTERED AIR CANDLE EXTINGUISHING DEVICE

(71) Applicant: Luis Morales, San Diego, CA (US)

(72) Inventor: Luis Morales, San Diego, CA (US)

( * ) Notice: Subject to any disclaimer, the term of this patent is extended or adjusted under 35 U.S.C. 154(b) by 353 days.

(21) Appl. No.: 14/989,006

(22) Filed: Jan. 6, 2016

(65) Prior Publication Data

US 2017/0191663 A1 Jul. 6, 2017

(51) Int. Cl.
*F23Q 25/00* (2006.01)

(52) U.S. Cl.
CPC ..... *F23Q 25/00* (2013.01)

(58) Field of Classification Search
CPC ..... F23Q 25/00; A62C 3/0207; A62C 3/008
See application file for complete search history.

(56) References Cited

U.S. PATENT DOCUMENTS

| | | | | |
|---|---|---|---|---|
| 1,333,011 | A | 3/1920 | Crady | |
| 8,029,232 | B2 | 10/2011 | Wyatt | |
| 8,820,425 | B2 | 9/2014 | Gatling et al. | |
| 2004/0224271 | A1 | 11/2004 | Langsam | |
| 2011/0048748 | A1* | 3/2011 | Gatling | F23Q 25/00 169/91 |
| 2013/0168112 | A1 | 7/2013 | Brown et al. | |
| 2014/0234790 | A1 | 8/2014 | Morris | |

* cited by examiner

*Primary Examiner* — Alfred Basichas

(57) ABSTRACT

A filtered air candle extinguishing device for sanitary candle extinguishing with filtered air includes a shell that is elongated. The shell has a first open end and a second open end. A mouthpiece is coupled to the first open end. The mouthpiece is configured to engage the lips of a user to form a seal. A filter is coupled to an interior face of the shell, defining a front chamber of the shell. The mouthpiece is positioned on the shell such that a user's lips can sealably couple to the mouthpiece. Air expelled by the user will create positive pressure in the front chamber, such that the air will pass through the filter. The filter retains spittle and the air exits the shell through the second open end to extinguish lighted candles on a cake.

14 Claims, 3 Drawing Sheets

FILTERED AIR CANDLE EXTINGUISHING DEVICE

BACKGROUND OF THE DISCLOSURE

Field of the Disclosure

The disclosure relates to candle extinguishing devices and more particularly pertains to a new candle extinguishing device for sanitary candle extinguishing with filtered air.

SUMMARY OF THE DISCLOSURE

An embodiment of the disclosure meets the needs presented above by generally comprising a shell that is elongated. The shell has a first open end and a second open end. A mouthpiece is coupled to the first open end. The mouthpiece is configured to engage the lips of a user to form a seal. A filter is coupled to an interior face of the shell, defining a front chamber of the shell. The mouthpiece is positioned on the shell such that a user's lips can sealably couple to the mouthpiece. Air expelled by the user will create positive pressure in the front chamber, such that the air will pass through the filter. The filter retains spittle and the air exits the shell through the second open end to extinguish lighted candles on a cake.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
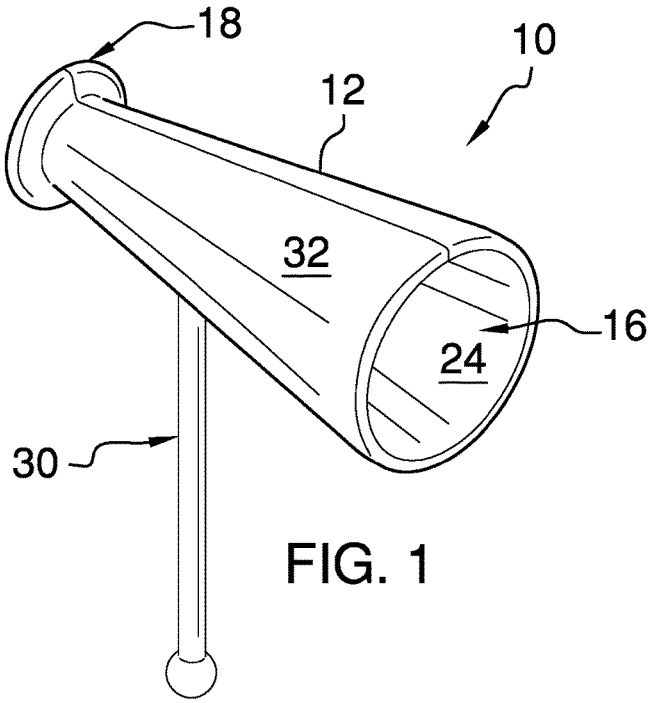
FIG. 1 is an isometric perspective view of a filtered air candle extinguishing device according to an embodiment of the disclosure.
Figure 2:
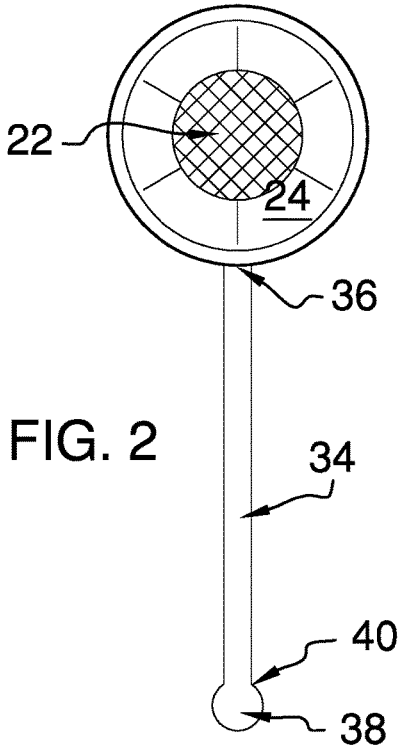
FIG. 2 is a back view of an embodiment of the disclosure.
Figure 3:
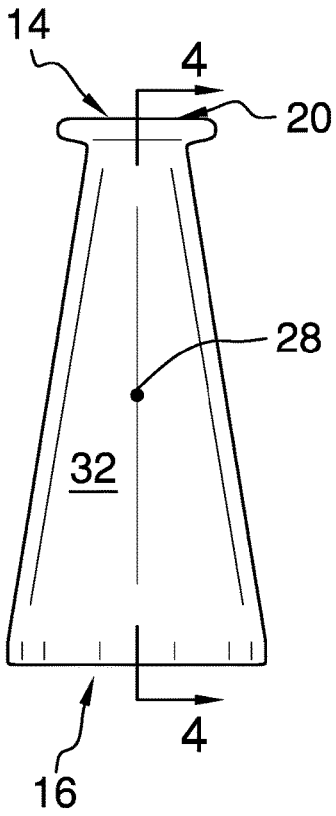
FIG. 3 is a top view of an embodiment of the disclosure.
Figure 4:
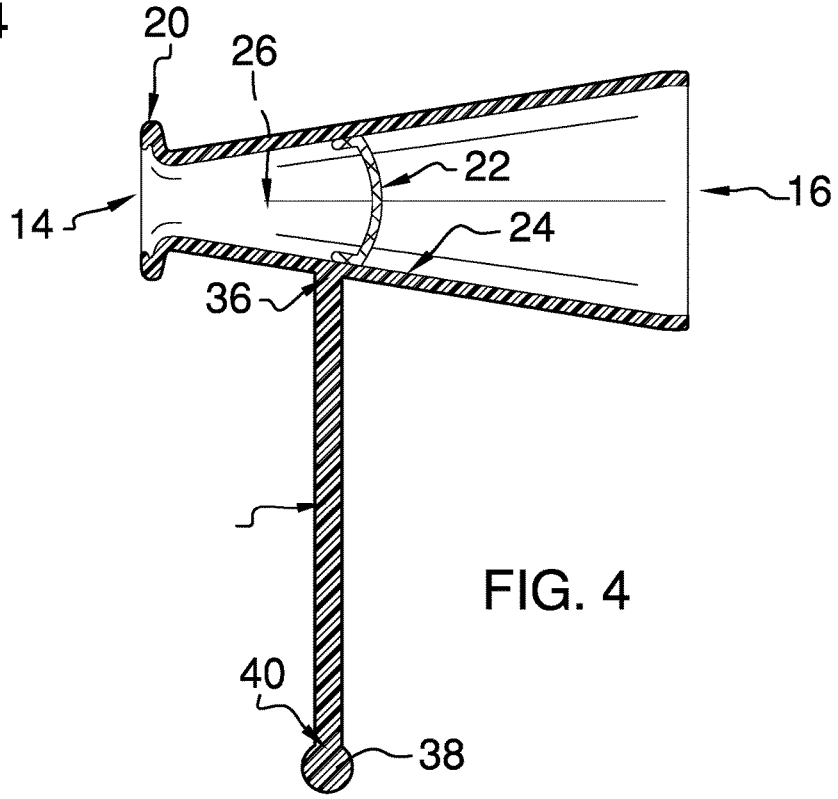
FIG. 4 is a cross-sectional view of an embodiment of the disclosure.
Figure 5:
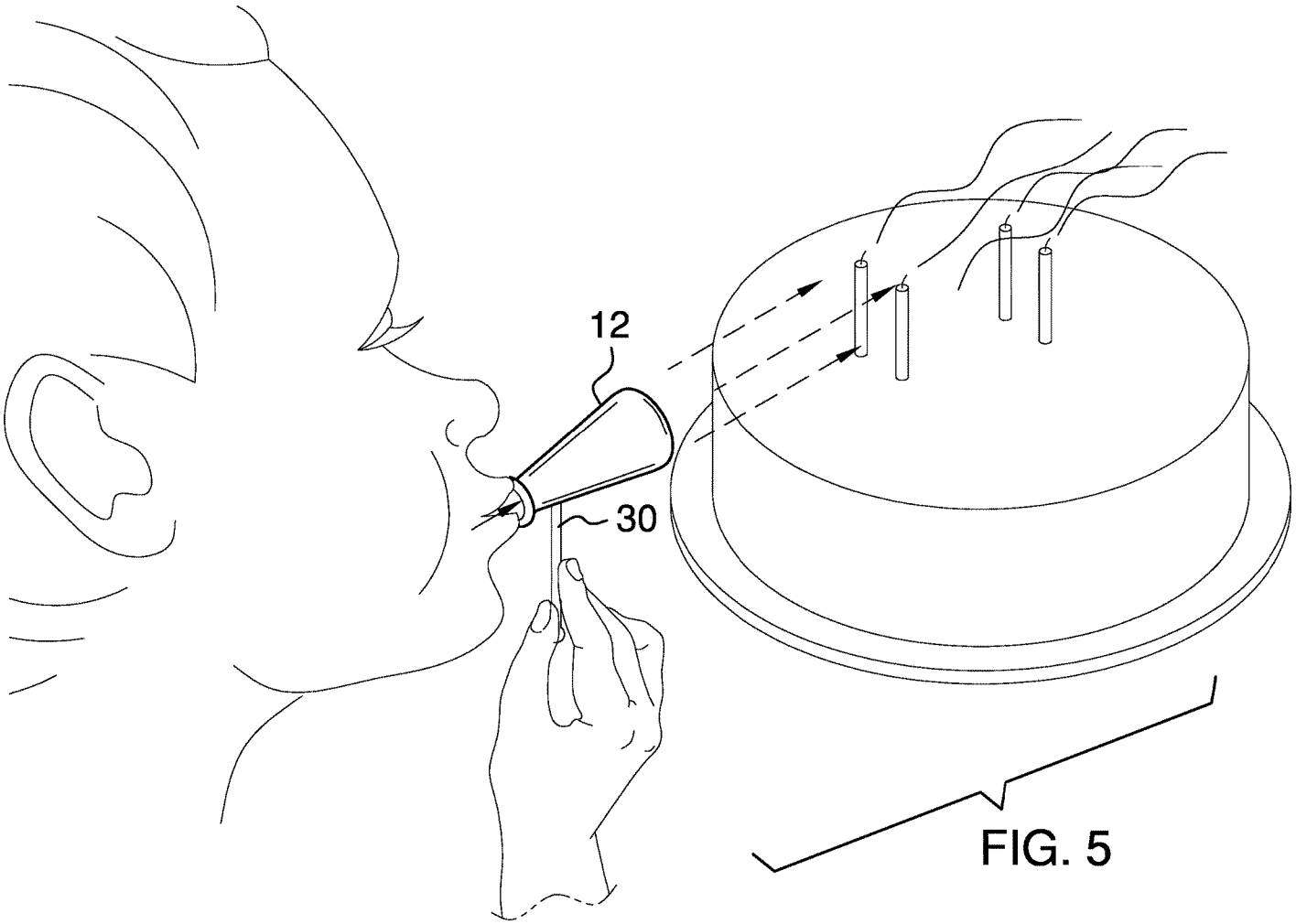
FIG. 5 is an in-use view of an embodiment of the disclosure.

With reference now to the drawings, and in particular to FIGS. 1 through 5 thereof, a new candle extinguishing device embodying the principles and concepts of an embodiment of the disclosure and generally designated by the reference numeral 10 will be described.

As best illustrated in FIGS. 1 through 5, the filtered air candle extinguishing device 10 generally comprises a shell 12 that is elongated. The shell 12 has a first open end 14 and a second open end 16. Preferably, the first open end 14 and the second open end 16 are circular. Also preferably, the second open end 16 is dimensionally larger than the first open end 14, such that the shell 12 is frustaconical.

A mouthpiece 18 is coupled to the first open end 14. The mouthpiece 18 is configured to engage the lips of a user to form a seal. The mouthpiece 18 has an outer perimeter 20. Preferably, the outer perimeter 20 is circumferentially larger than the first open end 14, such that the mouthpiece 18 is flared relative to the first open end 14.

A filter 22 is coupled to an interior face 24 of the shell 12, defining a front chamber 26 of the shell 12. The filter 22 is coupled to the interior face 24 between a longitudinal midpoint 28 of the shell 12 and the first open end 14 of the shell 12. Preferably, the filter 22 extends curvedly from the interior face 24 such that the filter 22 curves toward the second open end 16 of the shell 12. The filter 22 may be fixedly coupled to the shell 12. Alternatively, the filter 22 may be reversibly coupled to the shell 12, such that the filter 22 can be replaced.

A handle 30 is coupled to an exterior 32 of the shell 12. The handle 30 is configured for grasping by the user. The handle 30 comprises a rod 34 that has a first end 36 coupled to the shell 12. Preferably, the rod 34 is substantially circular when viewed longitudinally. A knob 38, preferably rounded, is coupled to a second end 40 of the rod 34.

The shell 12, the mouthpiece 18 and the handle 30 may comprise plastic.

In use, the mouthpiece 18 is positioned on the shell 12 such that a user's lips can sealably couple to the mouthpiece 18. Air expelled by the user will create positive pressure in the front chamber 26, such that the air will pass through the filter 22. The filter 22 retains spittle and the air exits the shell 12 through the second open end 16 to extinguish lighted candles on a cake.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A filtered air candle extinguishing device comprising:

a shell, said shell being elongated and having a first open end and a second open end, said second open end being dimensionally larger than said first open end, such that said shell is frustaconical, an entirety of said second end being in fluid communication with said first end;

a mouthpiece, said mouthpiece being coupled to said first open end, said mouthpiece being configured to engage the lips of a user to form a seal;

a filter, said filter being coupled to an interior face of said shell defining a front chamber of said shell; and wherein said mouthpiece is positioned on said shell such that a user's lips can sealably couple to said mouthpiece, wherein air expelled by the user will create positive pressure in said front chamber, such that the air will pass through said filter, wherein said filter retains spittle and the air exits said shell through said second open end to extinguish lighted candles on a cake.

2. The device of claim 1, further including said first open end and said second open end being circular.

3. The device of claim 1, further including said mouthpiece having an outer perimeter, said outer perimeter being circumferentially larger than said first open end, such that said mouthpiece is flared relative to said first open end.

4. The device of claim 1, further including said filter being coupled to said interior face between a longitudinal midpoint of said shell and said first open end of said shell.

5. The device of claim 1, further including said filter being curved such that said filter is concave facing said first end and convex facing said second end.

6. The device of claim 1, further including said filter being fixedly coupled to said shell.

7. The device of claim 1, further including said filter being removably coupled to said shell, such that said filter can be replaced.

8. The device of claim 1, further including a handle, said handle being coupled to an exterior of said shell, wherein said handle is configured for grasping by the user.

9. The device of claim 8, further including said handle comprising a rod, said rod having a first end, said first end of said rod being coupled to said shell.

10. The device of claim 9, further including said rod being substantially circular when viewed longitudinally.

11. The device of claim 9, further including said handle comprising a knob, said knob being coupled to a second end of said rod.

12. The device of claim 11, further including said knob being rounded.

13. The device of claim 8, further including said shell, said mouthpiece, and said handle comprising plastic.

14. A filtered air candle extinguishing device comprising:

a shell, said shell being elongated and having a first open end and a second open end, said first open end and said second open end being circular, said second open end being dimensionally larger than said first open end, such that said shell is frustaconical, an entirety of said second end being in fluid communication with said first end;

a mouthpiece, said mouthpiece being coupled to said first open end, said mouthpiece being configured to engage the lips of a user to form a seal, said mouthpiece having an outer perimeter, said outer perimeter being circumferentially larger than said first open end, such that said mouthpiece is flared relative to said first open end;

a filter, said filter being coupled to an interior face of said shell defining a front chamber of said shell, said filter being coupled to said interior face between a longitudinal midpoint of said shell and said first open end of said shell, being curved such that said filter is concave facing said first end and convex facing said second end, said filter being removably coupled to said shell, such that said filter can be replaced;

a handle, said handle being coupled to an exterior of said shell, wherein said handle is configured for grasping by the user;

said handle comprising:

a rod, said rod having a first end, said first end being coupled to said shell, said rod being substantially circular when viewed longitudinally, and a knob, said knob being coupled to a second end of said rod, said knob being rounded;

said shell, said mouthpiece, and said handle comprising plastic; and wherein said mouthpiece is positioned on said shell such that a user's lips can sealably couple to said mouthpiece, wherein air expelled by the user will create positive pressure in said front chamber, such that the air will pass through said filter, wherein said filter retains spittle and the air exits said shell through said second open end to extinguish lighted candles on a cake.

* * * * *